US011742111B2

(12) United States Patent
Mitsui et al.

(10) Patent No.: US 11,742,111 B2
(45) Date of Patent: Aug. 29, 2023

(54) END STRUCTURE AND SLEEVE OF SHIELDED CABLE

(71) Applicant: SUMITOMO WIRING SYSTEMS, LTD., Mie (JP)

(72) Inventors: Shohei Mitsui, Mie (JP); Norihito Hashimoto, Mie (JP); Motoki Kubota, Mie (JP); Keisuke Kanemura, Mie (JP); Wataru Yamanaka, Mie (JP); Shinobu Wakahara, Aichi-ken (JP)

(73) Assignee: SUMITOMO WIRING SYSTEMS, LTD., Mie (JP)

( * ) Notice: Subject to any disclaimer, the term of this patent is extended or adjusted under 35 U.S.C. 154(b) by 0 days.

(21) Appl. No.: 17/374,152

(22) Filed: Jul. 13, 2021

(65) Prior Publication Data

US 2022/0028580 A1 Jan. 27, 2022

(30) Foreign Application Priority Data

Jul. 27, 2020 (JP) ..... 2020-126665

(51) Int. Cl.

| | |
|---|---|
| ***H01B 7/24*** | (2006.01) |
| ***H01B 7/18*** | (2006.01) |
| ***H01B 7/22*** | (2006.01) |
| ***H01R 4/18*** | (2006.01) |

(52) U.S. Cl.

CPC ..... *H01B 7/24* (2013.01); *H01B 7/1875* (2013.01); *H01B 7/228* (2013.01); *H01R 4/185* (2013.01)

(58) Field of Classification Search

None

See application file for complete search history.

(56) References Cited

U.S. PATENT DOCUMENTS

| | | | | | |
|---|---|---|---|---|---|
| 2,736,872 | A * | 2/1956 | Willans | H01R 9/0518 | 439/585 |
| 3,196,382 | A * | 7/1965 | Morello, Jr. | H01R 9/0518 | 439/585 |
| 3,283,287 | A * | 11/1966 | Stark | H01R 9/0518 | 439/585 |
| 3,295,076 | A * | 12/1966 | Kraus | H01R 9/0518 | 333/260 |
| 3,499,101 | A * | 3/1970 | Hogendobler | H01R 43/058 | 439/585 |
| 3,519,729 | A * | 7/1970 | La Van | H01R 9/0518 | 174/84 C |
| 3,566,007 | A * | 2/1971 | O'Keefe | H01R 43/058 | 174/750 |

(Continued)

FOREIGN PATENT DOCUMENTS

| | | | | |
|---|---|---|---|---|
| CN | 106531300 A | * | 3/2017 | |
| CN | 206585165 U | * | 10/2017 | H01R 13/5202 |

(Continued)

*Primary Examiner* — Timothy J. Dole
*Assistant Examiner* — Muhammed Azam
(74) *Attorney, Agent, or Firm* — Venjuris, P.C.

(57) ABSTRACT

An end structure of a shielded cable 10 includes a core 11, an insulator 12 for covering the core 11, a foil 13 for covering the insulator 12, a braided wire 14 for covering the foil 13, a sheath 15 for covering the braided wire 14 and a sleeve 17 arranged between the braided wire 14 and the foil 13 exposed from an end part of the sheath 15. The end part of the sheath 15 and the sleeve 17 are separated from each other to form a clearance 50.

12 Claims, 6 Drawing Sheets

(56) References Cited

U.S. PATENT DOCUMENTS 3,699,504 A * 10/1972 Huber ..... H01R 9/0518 439/585
4,059,330 A * 11/1977 Shirey ..... H01R 9/0518 29/874
4,173,385 A * 11/1979 Fenn ..... H01R 9/05 439/585
5,037,328 A * 8/1991 Karlovich ..... H01R 24/40 439/578
5,102,351 A * 4/1992 Meshel ..... H01R 13/65912 439/585
5,273,458 A * 12/1993 Fisher, Jr. ..... H01R 24/44 439/585
5,619,790 A * 4/1997 Takanashi ..... H02G 1/1256 29/857
5,651,699 A * 7/1997 Holliday ..... H01R 9/0518 439/585
5,823,803 A * 10/1998 Majors ..... H01R 13/6584 439/98
5,975,951 A * 11/1999 Burris ..... H01R 13/5202 439/585
6,019,615 A * 2/2000 Masuda ..... H01R 9/0518 174/653
6,107,572 A * 8/2000 Miyazaki ..... H01R 9/0518 174/75 C
6,210,222 B1 * 4/2001 Langham ..... H01R 9/0518 439/578
6,210,223 B1 * 4/2001 Aoyama ..... H01R 13/6593 439/585
6,384,335 B1 * 5/2002 Saito ..... H01R 9/0518 439/585
6,530,789 B2 * 3/2003 Konda ..... H01R 9/0518 439/98
2004/0198095 A1 * 10/2004 Laverick ..... H01R 9/0518 439/585
2005/0287875 A1 * 12/2005 Kojima ..... H01R 24/44 439/750
2006/0211304 A1 * 9/2006 Holland ..... H01R 9/0518 439/585
2007/0087626 A1 * 4/2007 Harwath ..... H01R 9/0518 439/578
2011/0056070 A1 * 3/2011 Mori ..... H02G 1/14 29/728
2012/0244733 A1 * 9/2012 Amidon ..... H01R 13/622 439/271
2014/0017937 A1 * 1/2014 Holliday ..... H01R 24/38 439/585
2015/0075862 A1 * 3/2015 Oka ..... H01R 9/0518 174/72 A
2015/0126063 A1 * 5/2015 Hannah ..... H01R 4/023 439/585
2015/0155644 A1 * 6/2015 Kato ..... H01R 9/0518 439/578
2017/0237183 A1 * 8/2017 Suso ..... H01R 43/048 439/585
2018/0198266 A1 * 7/2018 Inoue ..... H01R 13/115
2019/0295744 A1 * 9/2019 Kobayashi ..... B60T 8/17
2020/0058418 A1 * 2/2020 Izawa ..... H01B 7/20
2020/0274263 A1 * 8/2020 Hashimoto ..... H01R 9/0518
2022/0028580 A1 * 1/2022 Mitsui ..... H01R 9/0518

FOREIGN PATENT DOCUMENTS

CN 109155469 A * 1/2019 ..... H01R 13/631
CN 109565120 A * 4/2019 ..... H01R 13/5804
CN 111628366 A * 9/2020 ..... H01R 13/6581
DE 3804870 A1 * 8/1988
DE 3836141 A1 * 4/1990
DE 3932679 A1 * 4/1991
DE 4310972 A1 * 10/1994 ..... H01R 9/0518
DE 19606827 A1 * 9/1996 ..... H01R 13/111
DE 19528235 A1 * 2/1997 ..... H01R 9/0518
DE 202015000751 U1 * 4/2015 ..... H01R 13/6474
DE 102017005597 A1 * 11/2017
DE 102018212084 A1 * 1/2019 ..... H01R 4/185
DE 102020133781 A1 * 7/2021
EP 0328234 A2 * 8/1989
EP 0667046 B1 * 8/1995
EP 0986135 A1 * 3/2000
HU 201426 B * 8/1989
JP H03-071580 U 7/1991
JP 2005-197068 A 7/2005
JP 2010-232046 A 10/2010
JP 6551764 B1 * 7/2019 ..... H01R 13/02
JP 6708145 B2 * 6/2020 ..... H01B 7/20
KR 101653437 B1 * 9/2016
WO WO-2018096854 A1 * 5/2018 ..... H01B 11/00
WO WO-2020137732 A1 * 7/2020 ..... H01R 13/502

* cited by examiner

END STRUCTURE AND SLEEVE OF SHIELDED CABLE

CROSS-REFERENCE TO RELATED APPLICATIONS

This application is based on and claims priority from Japanese Patent Application No. 2020-126665, filed on Jul. 27, 2020, with the Japan Patent Office, the disclosure of which is incorporated herein in their entireties by reference.

TECHNICAL FIELD

The present disclosure relates to an end structure and a sleeve of a shielded cable.

BACKGROUND

A shielded cable constitutes a transmission line for transmitting a high-frequency electrical signal. For example, Japanese Patent Laid-open Publication No. 2010-232046 discloses a sleeve arranged between a braided wire and an insulator exposed in an end part of a shielded cable. The sleeve is pressed and deformed by a barrel of a terminal. The braided wire is held by being sandwiched between the sleeve and the barrel. An end structure and a sleeve of a shielded cable of this type are also disclosed in Japanese Patent Laid-open Publication No. 2005-197068 and Japanese Utility Model Publication No. H03-071580.

SUMMARY

If a foil made of metal is provided inside the braided wire in addition to the above configuration and the foil is arranged to cover the insulator, it is preferred since transmission characteristics can be further improved. However, if this configuration is adopted, the sleeve is inserted between the foil and the braided wire and the foil possibly interferes with the sleeve to be peeled. If the shielded cable is used without the peeling of the foil being noticed, there is a problem that desired transmission characteristics cannot be obtained.

Accordingly, the present disclosure aims to provide an end structure and a sleeve of a shielded cable capable of detecting a state of a foil.

A shielded cable end structure of the present disclosure includes a core, an insulator for covering the core, a foil for covering the insulator, a braided wire for covering the foil, a sheath for covering the braided wire, and a sleeve arranged between the braided wire and the foil exposed from an end part of the sheath, the end part of the sheath and the sleeve being separated from each other to form a clearance.

According to the present disclosure, it is possible to provide an end structure and a sleeve of a shielded cable capable of detecting a state of a foil.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

Figure 1:
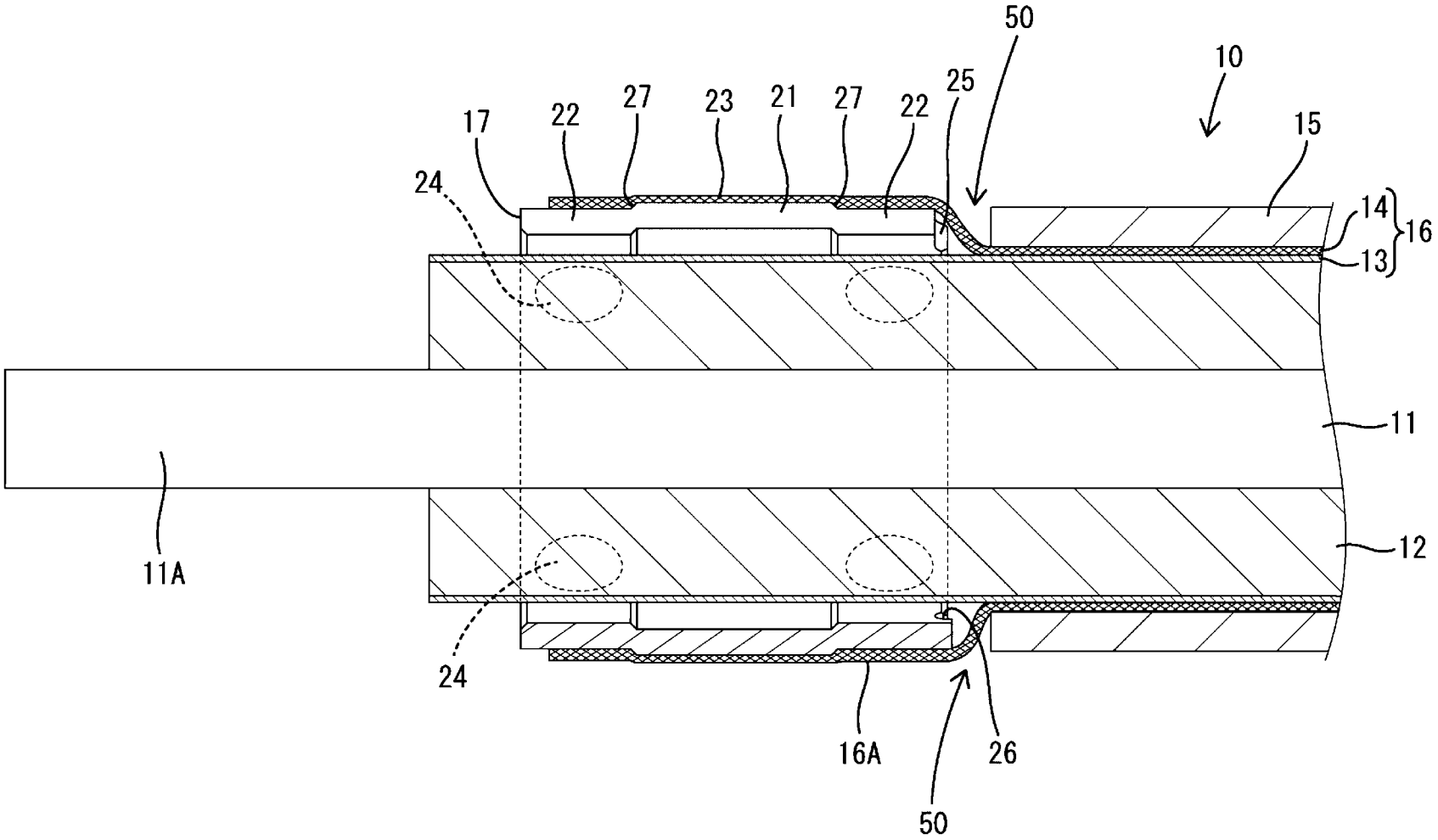
FIG. 1 is a side cross sectional view showing an end structure of a shielded cable in an embodiment of the present disclosure.

In the following detailed description, reference is made to the accompanying drawings, which form a part hereof. The illustrative embodiments described in the detailed description, drawings, and claims are not meant to be limiting. Other embodiments may be utilized, and other changes may be made, without departing from the spirit or scope of the subject matter presented here.

Description of Embodiments of Present Disclosure

First, embodiments of the present disclosure are listed and described.

(1) The shielded cable end structure of the present disclosure includes a core, an insulator for covering the core, a foil for covering the insulator, a braided wire for covering the foil, a sheath for covering the braided wire, and a sleeve arranged between the braided wire and the foil exposed from an end part of the sheath, the end part of the sheath and the sleeve being separated from each other to form a clearance. According to this, if the foil is peeled, the clearance becomes smaller and a bulge of the braided wire is formed in the clearance. Thus, the peeling of the foil can be known by seeing this bulge of the braided wire. In contrast, if the foil is not peeled, the bulge of the braided wire is not formed in the clearance. Thus, it can be judged that the foil is not peeled. Therefore, according to the configuration of the present disclosure, a state of the foil, e.g. whether or not the foil is peeled, can be detected.

(2) Preferably, the sleeve includes a tubular sleeve body having an inner diameter larger than an outer diameter of the foil. According to this, the sleeve body can be arranged outside the foil in a state where the contact of the sleeve body and the foil is avoided, and the peeling of the foil can be suppressed in advance.

(3) Preferably, the sleeve includes a plurality of protrusions arranged at intervals in a circumferential direction of the sleeve body and the plurality of protrusions are formed to project radially inwardly and contact the foil. According to this, the plurality of protrusions can contact the foil and the detachment (separation) of the sleeve from the shielded cable can be hindered.

(4) Preferably, the sleeve body includes a small-diameter tube portion and a large-diameter tube portion arranged side by side with the small-diameter tube portion and having a larger diameter than the small-diameter tube portion, and an outer surface of the large-diameter tube portion serves as a receiving surface pressable by a barrel of a terminal. According to this, the contact of the large-diameter tube portion with the foil can be reliably avoided. Further, the large-diameter tube portion can have both a function of suppressing the peeling of the foil and a function of receiving a pressing force of the terminal.

(5) Preferably, the large-diameter tube portion is arranged in a central part in an axial direction of the sleeve body, the small-diameter tube portions are arranged on both end parts in the axial direction of the sleeve body, and the same plurality of protrusions are separately arranged on each of the small-diameter tube portions on the both end parts in the axial direction of the sleeve body. According to this, directivity in the axial direction of the sleeve can be eliminated. As a result, for example, a mounting direction of the sleeve needs not be identified.

(6) Preferably, the sleeve includes a recess recessed in a direction away from the end part of the sheath on an edge part facing the end part of the sheath. According to this, the clearance can be expanded and a wide region for confirming the bulge of the braided wire and the like can be ensured at a position where the recess is formed. As a result, reliability in detecting the state of the foil can be enhanced.

Further, the present disclosure includes a sleeve in the shielded cable end structure described in any one of (1) to (6) above. According to this, since the sleeve is located away from the end part of the sheath, the entire length of the sleeve can be shortened and material cost can be reduced.

Details of Embodiment of Present Disclosure

Hereinafter, a specific embodiment of the present disclosure is described with reference to the drawings. Note that the present invention is not limited to these illustrations and is intended to be represented by claims and include all changes in the scope of claims and in the meaning and scope of equivalents.

Figure 2:
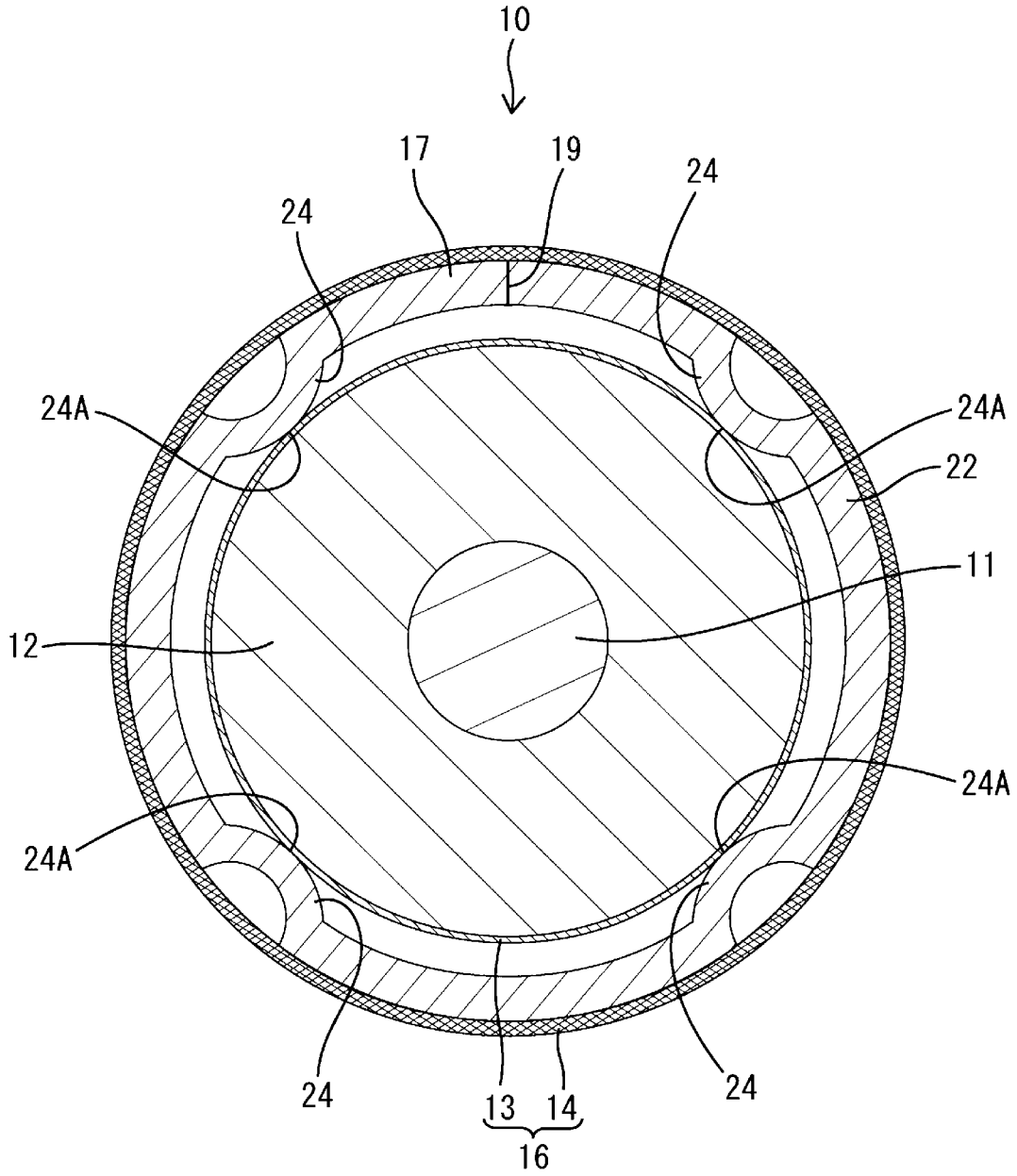
FIG. 2 is a longitudinal cross sectional view showing the end structure of the shielded cable.

A shielded cable 10 is installed in a vehicle such as an automotive vehicle. The shielded cable 10 has a circular cross-section as a whole and includes, as shown in FIGS. 1 and 2, a core 11 made of metal and located at a radial center, an insulator 12 made of foamed resin for covering the outer periphery of the core 11, a foil 13 made of metal such as a copper foil for covering the outer periphery of the insulator 12, a braided wire 14 made of metal for covering the outer periphery of the foil 13 and a sheath 15 made of insulating resin for covering the outer periphery of the braided wire 14. The core 11, the insulator 12, the foil 13, the braided wire 14 and the sheath 15 are concentrically arranged with an axis of the core 11 as a center. The foil 13 and the braided wire 14 constitute a shield layer 16 for shielding electromagnetic noise. Out of these, the foil 13 functions to adjust an impedance of a transmission line to a specified value.

An end processing such as stripping is applied to an end part of the shielded cable 10, whereby a tip part 16A of the shield layer 16 is exposed in front of the sheath 15 (tip of the shielded cable 10) as shown in FIG. 1. A tip part 11A of the core 11 is exposed forward of the front end of the insulator 12.

The end part of the shielded cable 10 includes a sleeve 17 in the tip part 16A of the shield layer 16. The sleeve 17 has a hollow cylindrical shape and is arranged between the foil 13 and the braided wire 14 in a radial direction. The sleeve 17 receives a pressing force (crimping force, fixing force) from a barrel 31 of a terminal 30. A specific structure of the sleeve 17 is described later.

Figure 3:
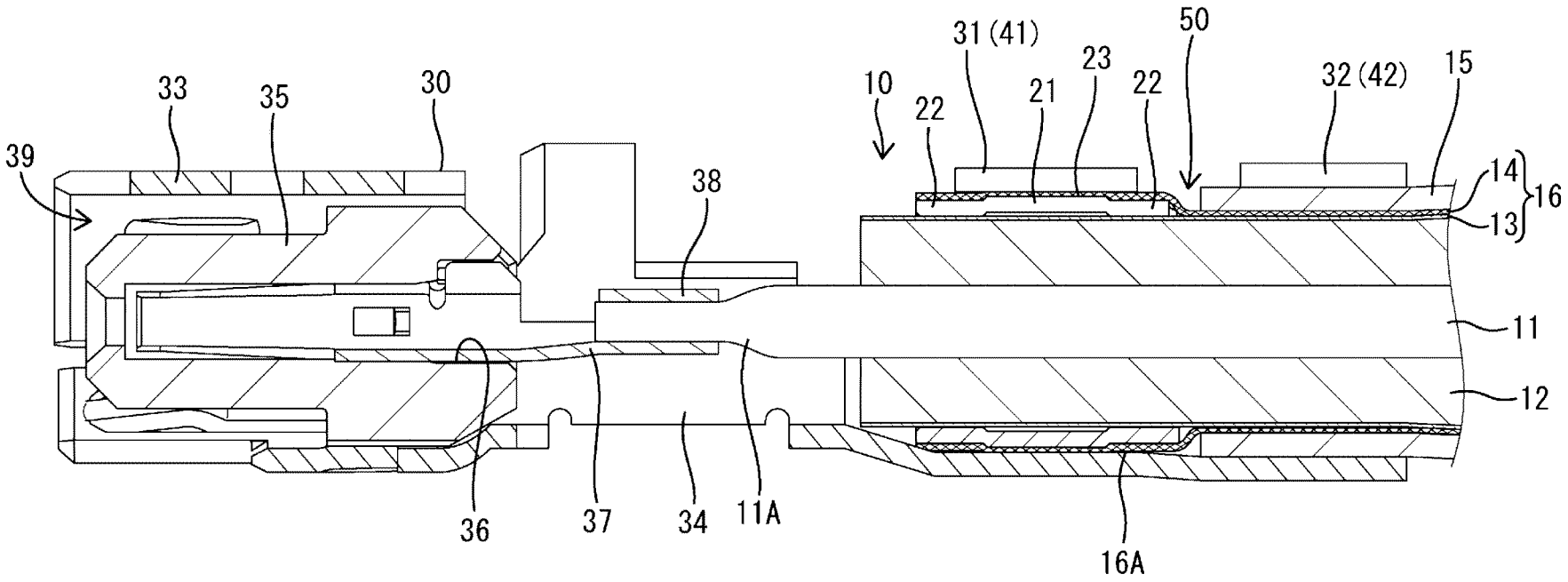
FIG. 3 is a side cross sectional view showing a state where the shielded cable is connected to a terminal.

The terminal 30 is formed by bending a conductive metal plate material and includes, as shown in FIG. 3, a sheath barrel 32 and a terminal body 33 in addition to the aforementioned barrel 31. The terminal body 33 has a hollow cylindrical shape and is arranged forward of the barrel 31. The terminal body 33 and the barrel 31 are coupled via coupling portions 34 (only one is shown in FIG. 3) paired in a lateral direction (direction orthogonal to the plane of FIG. 3).

A dielectric 35 made of resin is accommodated inside the terminal body 33. The dielectric 35 includes an accommodating portion 36 penetrating in a front-rear direction. An inner conductor terminal 37 is inserted into the accommodating portion 36. The inner conductor terminal 37 has a projecting part projecting rearward of the dielectric 35 while being inserted in the accommodating portion 36, and includes a core connecting portion 38 in this projecting part. The core connecting portion 38 is arranged between the pair of coupling portions 34 and crimped and connected to the tip part 11A of the core 11.

A fitting space 39 open forward is formed between the outer surface of the dielectric 35 and the terminal body 33. An unillustrated mating terminal is fit into the fitting space 39. The mating terminal is electrically connected to the terminal body 33. Further, the mating terminal is connected to a ground layer of an unillustrated circuit board. An unillustrated mating inner conductor terminal is inserted into the accommodating portion 36 through a front surface opening of this accommodating portion 36. The mating inner conductor terminal is electrically connected to the inner conductor terminal 37.

The barrel 31 is an open barrel and includes a pair of left and right barrel pieces 41 (not shown in detail in FIG. 3). The barrel 31 is crimped and connected to the braided wire 14 with the sleeve 17 laid under the barrel 31. Each barrel piece 41 is wound along the outer periphery of the braided wire 14.

The sheath barrel 32 is arranged behind the barrel 31. The sheath barrel 32 is an open barrel and includes a pair of left and sheath barrel pieces 42 (not shown in detail in FIG. 3), similarly to the barrel 31. The sheath barrel 32 is directly crimped and connected to the sheath 15 without via the sleeve 17. Each sheath barrel piece 42 is wound along the outer periphery of the sheath 15.

Figure 4:
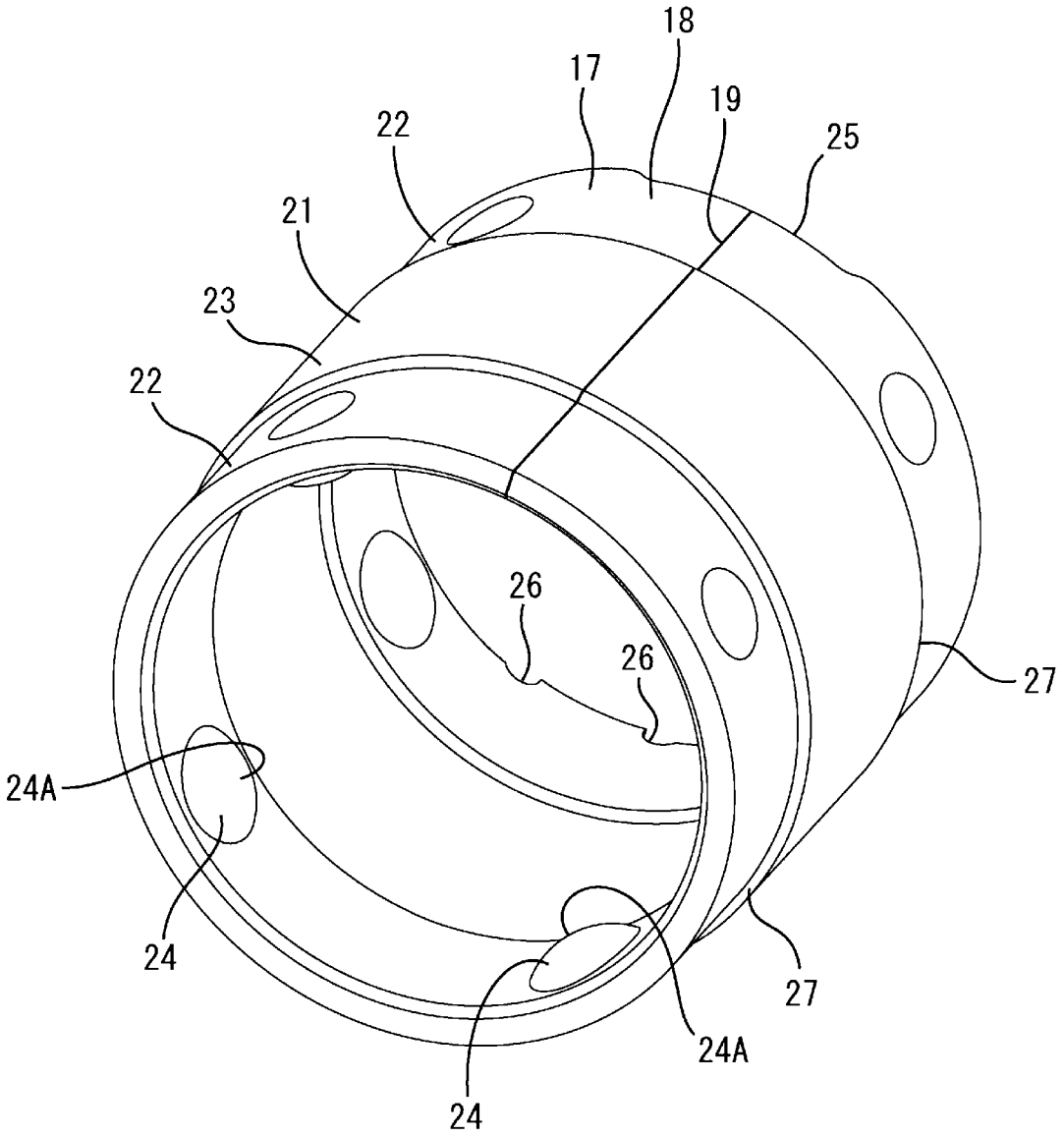
FIG. 4 is a perspective view of a sleeve.
Figure 5:
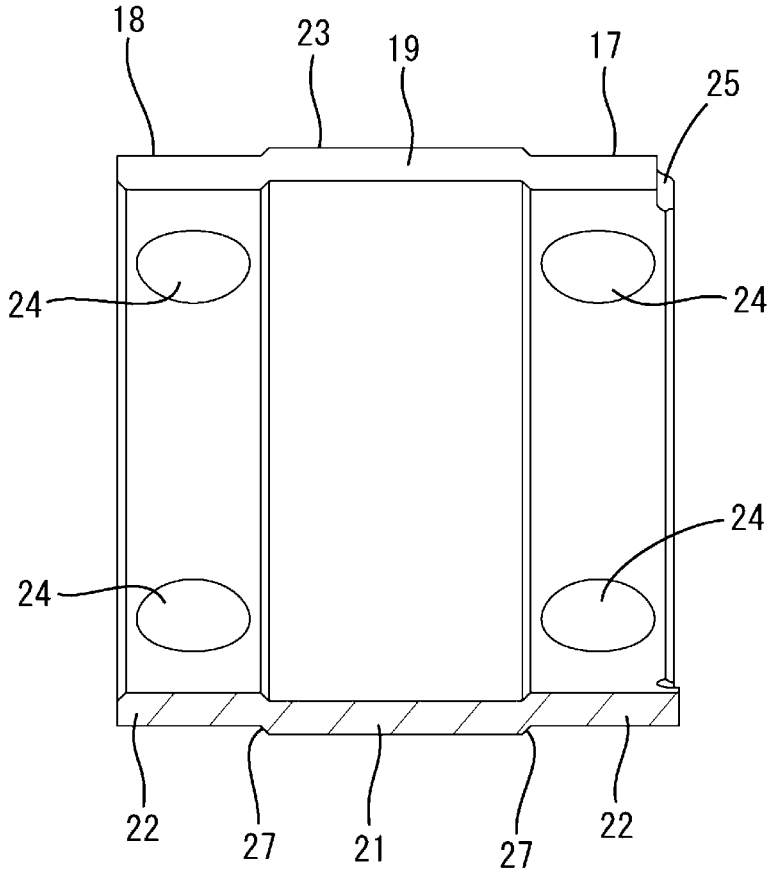
FIG. 5 is a side view in section of the sleeve.

The sleeve 17 is made of metal such as stainless steel and includes, as shown in FIGS. 4 and 5, a hollow cylindrical sleeve body 18 penetrating in the front-rear direction. The sleeve body 18 is formed into a hollow cylindrical shape by rolling a rectangular plate material. The sleeve body 18 includes mating edges 19 along the front-rear direction (axial direction) on an upper end. The sleeve body 18 maintains the hollow cylindrical shape with the mating edges 19 butted against each other.

An axial length of the sleeve 17 (length in the front-rear direction, same as an axial length of the sleeve body 18) is shorter than that of the tip part 16A of the shield layer 16.

The sleeve body 18 includes a large-diameter tube portion 21 in a central part in the front-rear direction and a pair of front and rear small-diameter tube portions 22 on both end parts in the front-rear direction. The large-diameter tube portion 21 is formed to have a larger diameter than each small-diameter tube portion 22. A pair of front and rear steps 27 are formed between the large-diameter tube portion 21 and the respective small-diameter tube portions 22. The respective small-diameter tube portions 22 are coupled side by side with the large-diameter tube portion 21 via the respective steps 27. The respective steps 27 are tapered to be reduced in diameter from the large-diameter tube portion 21 to the respective small-diameter tube portions 22. The respective small-diameter tube portions 22 are formed to have the same axial length. The axial length of each small-diameter tube portion 22 is shorter than that of the large-diameter tube portion 21.

The large-diameter tube portion 21 is shaped to bulge radially outward with respect to each small-diameter tube portion 22 over the entire circumference of the sleeve body 18. The large-diameter tube portion 21 is formed to have a constant thickness in the front-rear direction. The inner and outer surfaces of the large-diameter tube portion 21 are arranged along the front-rear direction. Out of these, the outer surface of the large-diameter tube portion 21 is formed as a receiving surface 23 facing the barrel 31 via the braided wire 14 to receive a pressing force of the barrel 31.

Each small-diameter tube portion 22 is likewise formed to have a constant thickness in the front-rear direction and has inner and outer surfaces along the front-rear direction. The thickness of each small-diameter tube portion 22 is equal to that of the large-diameter tube portion 21. As shown in FIG. 1, an inner diameter of each small-diameter tube portion 22 is larger than an outer diameter of the foil 13 covering the insulator 12.

As shown in FIGS. 4 and 5, the sleeve 17 includes a plurality of protrusions 24 projecting radially inwardly of each small-diameter tube portion 22. The same number (specifically, four) of the protrusions 24 are arranged on each of the small-diameter tube portions 22. The respective protrusions 24 are arranged at intervals (specifically, equal intervals) in a circumferential direction on the inner surface of each small-diameter tube portion 22. The respective protrusions 24 are arranged in the same alignment on each of the small-diameter tube portions 22.

Each protrusion 24 is formed into an embossed shape by press-working the outer surface of each small-diameter tube portion 22. Specifically, as shown in FIG. 2, each protrusion 24 has a dome shape (spherical surface shape) projecting radially inwardly of each small-diameter tube portion 22. A top part 24A of each protrusion 24 can contact the foil 13 covering the insulator 12.

As shown in FIGS. 4 and 5, the sleeve 17 includes a recess 25 cut to be open on the upper end rear edge of the rear small-diameter tube portion 22. The back end (front end) of the recess 25 is arranged along the circumferential direction (width direction). The back end of the recess 25 intersects at a right angle with the rear ends of the mating edges 19. The sleeve 17 includes two auxiliary recesses 26 cut to be open on the lower end rear edge of the rear small-diameter tube portion 22. The respective auxiliary recesses 26 have an opening width smaller than the recess 25 and are arranged side by side in the circumferential direction. The sleeve 17 is shaped to be line-symmetrical (symmetrical) with respect to a center in the front-rear direction except the recess 25 and the respective auxiliary recesses 26.

Next, a mounting method and a mounting structure (end structure of the shielded cable 10) of the sleeve 17 are described.

The sleeve 17 is inserted into between the braided wire 14 and the foil 13 in the end part of the shielded cable 10 from front. When the insertion of the sleeve 17 is started, the contact of the rear small-diameter tube portion 22 and the foil 13 can be avoided since the inner surface of the rear small-diameter tube portion 22 is located away from the foil 13.

With the foil 13 arranged inside the rear small-diameter tube portion 22, the top part 24A of each protrusion 24 on the rear small-diameter tube portion 22 is in point contact with the outer surface of the foil 13. In a final stage of the insertion process of the sleeve 17, the top part 24A of each protrusion 24 on the front small-diameter tube portion 22 is also in point contact with the outer surface of the foil 13. Thereafter, while the inserting operation of the sleeve 17 progresses, the tip part 24A of each protrusion 24 slides on the outer surface of the foil 13.

Since the large-diameter tube portion 21 having a large diameter is arranged between the front and rear small-diameter tube portions 22 and the inner surface of the large-diameter tube portion 21 is located away from the foil 13, the contact of the large-diameter tube portion 21 and the foil 13 is avoided while the inserting operation of the sleeve 17 progresses. In other words, the foil 13 contacts the sleeve 17 only via the tip part 24A of each protrusion 24. By the contact of the tip part 24A of each protrusion 24 with the outer surface of the foil 13, the detachment (separation) of the sleeve 17 from the shield layer 16 is hindered.

The braided wire 14 deeply covers the outer surface of the sleeve 17. As shown in FIG. 1, if the sleeve 17 is properly inserted into the shield layer 16, the outer surface of the sleeve 17 is covered by the braided wire 14 except a front end part of the front small-diameter tube portion 22.

With the sleeve 17 properly inserted in the shield layer 16, the sleeve 17 is arranged away from the front end of the sheath 15. That is, a clearance 50 is formed in the front-rear direction between the rear end of the sleeve 17 and the front end of the sheath 15.

Figure 6:
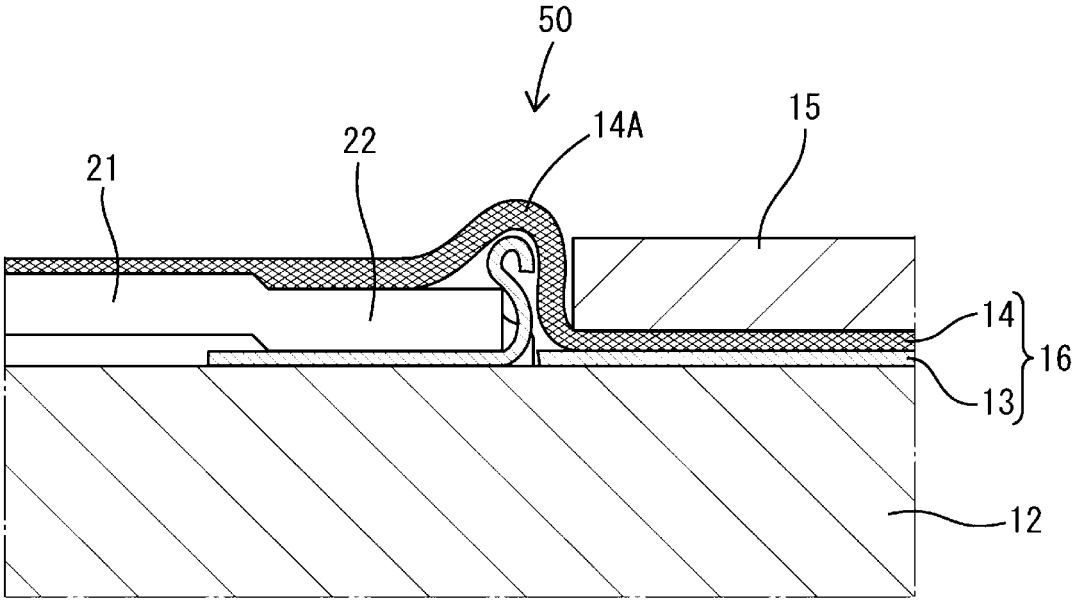
FIG. 6 is an enlarged section showing a state where a foil is peeled and a braided wire is bulging.

If the foil 13 is peeled or broken due to the contact of each protrusion 24 and the foil 13 in the insertion process of the sleeve 17, the sleeve 17 excessively approaches the sheath 15 and the clearance 50 becomes smaller than a normal value. Thus, as shown in FIG. 6, the foil 13 enters the clearance 50 to form a bulge 14A of the braided wire 14. Therefore, the peeling of the foil 13 can be known by visually confirming this bulge 14A. In contrast, if there is no bulge 14A of the braided wire 14 and the braided wire 14 is tapered and reduced in diameter from the outer surface of the sleeve 17 to the inner surface of the sheath 15 in the clearance 50 as shown in FIG. 1, it can be judged that the foil 13 is not peeled. Therefore, according to this embodiment, whether or not the foil 13 is peeled can be visually detected.

Particularly in the case of this embodiment, the recess 25 recessed in the direction away from the front end of the sheath 15 is provided on the rear end of the sleeve 17. Thus, the clearance 50 is expanded by the recess 25 and a visual confirmation region where the state of the foil 13 is confirmed via the bulge 14A of the braided wire 14 is also expanded. Therefore, reliability in visually detecting the state of the foil 13 can be enhanced.

Thereafter, the sleeve 17 is crimped to and supported by the terminal 30. The sleeve 17 is pressed radially inwardly by the barrel 31 in a crimping process of the terminal 30. As shown in FIG. 3, the barrel 31 is arranged to face the receiving surface 23 of the sleeve 17 via the braided wire 14. Each protrusion 24 is pressed by the barrel 31 and is fixed to the outer surface of the insulator 12 via the foil 13 while applying a compressive force.

Each small-diameter tube portion 22 is pressed by the barrel 31 to contact the foil 13. The large-diameter tube portion 21 is arranged away from the foil 13 without contacting the foil 13 even if being pressed by the barrel 31. If a pressing force of the barrel 31 is large and the sleeve 17 is deformed to such an extent that the steps 27 disappear, the large-diameter tube portion 21 also contacts the foil 13. On the contrary, if the pressing force of the barrel 31 is small, only each protrusion 24 contacts the foil 13 and each small-diameter tube portion 22 is arranged away from the foil 13 without contacting the foil 13.

Even after the end part of the shielded cable 10 is connected to the terminal 30, the peeling of the foil 13 can be known by visually confirming the bulge 14A of the braided wire 14 through the clearance 50.

As described above, according to this embodiment, the peeling of the foil 13 can be known by seeing the bulge 14A of the braided wire 14 through the clearance 50 formed between the front end of the sheath 15 and the rear end of the sleeve 17. In contrast, if the bulge 14A of the braided wire 14 is not formed in the clearance 50, it can be judged that the foil 13 is not peeled. Thus, the state of the foil 13, e.g. whether or not the foil 13 is peeled, can be detected. Particularly, since the clearance 50 is expanded and the wide visual confirmation region for seeing the bulge 14A of the braided wire 14 and the like can be secured at a position where the recess 25 is formed, reliability in detecting the state of the foil 13 can be enhanced.

The sleeve 17 is formed to be shorter in the axial direction by as much as the sleeve 17 is separated from the rear end of the sheath 15. Thus, the material cost of the sleeve 17 can be reduced. Further, the braided wire 14 is not caught between the sleeve 17 and the sheath 15 and a concern for reducing a pressing force (crimping force, fixing force) of the sheath barrel 32 can be eliminated.

Further, the inner diameter of the sleeve body 18 is set to be larger than the outer diameter of the foil 13 covering the insulator 12 including the inner diameter of each small-diameter tube portion 22. Thus, in the process of inserting the sleeve 17 into the shield layer 16, the contact of the sleeve body 18 with the foil 13 can be avoided and the peeling of the foil 13 can be suppressed in advance. Particularly, since the large-diameter tube portion 21 has a larger diameter than each small-diameter tube portion 22, the contact thereof with the foil 13 is more easily avoided.

On the other hand, the plurality of protrusions 24 projecting radially inwardly of each small-diameter tube portion 22 contact the foil 13, thereby hindering the detachment of the sleeve 17 from the shield layer 16.

Further, in the case of this embodiment, the large-diameter tube portion 21 is provided in the central part in the front-rear direction of the sleeve body 18, the respective small-diameter tube portions 22 are provided on both end parts in the front-rear direction of the sleeve body 18 and the same number of the protrusions 24 are arranged in the same alignment in each of the small-diameter tube portions 22. Thus, directivity in the front-rear direction of the sleeve 17 can be eliminated. For example, when the sleeve 17 is inserted into the shield layer 16, the front-rear orientation of the sleeve 17 needs not be identified.

Other Embodiments of Present Disclosure

The embodiment disclosed this time should be considered illustrative in all aspects, rather than restrictive.

Although the respective small-diameter tube portions are arranged side by side with the large-diameter tube portion on both sides of the large-diameter tube portion in the case of the above embodiment, a small-diameter tube portion may be arranged side by side with a large-diameter tube portion only on one of both front and rear sides of the large-diameter tube portion as another embodiment.

Although the sleeve body includes the large-diameter tube portion and the respective small-diameter tube portions in the case of the above embodiment, a sleeve body may be formed to have the same diameter in the front-rear direction (axial direction) as another embodiment. If the sleeve body has the same diameter in the front-rear direction, an inner diameter of the sleeve body may be set to be larger than an outer diameter of a foil covering an insulator and each protrusion may be formed to project radially inwardly of the sleeve body and contact the foil.

Although the braided wire is arranged on the outer surface side of the sleeve in the case of the above embodiment, a braided wire may be bent and folded from an inner surface side to an outer surface side of a sleeve as another embodiment.

Although the symmetry of the sleeve in the front-rear direction is lost by the presence of the recess and the respective auxiliary recesses in the case of the above embodiment, the symmetry of a sleeve in the front-rear direction may be ensured regardless of whether or not a recess and respective auxiliary recesses are formed as another embodiment.

Although the state of the foil is detected by the bulge of the braided wire formed in the clearance in the case of the above embodiment, a detection method is not limited to this. For example, the state of the foil may be seen through meshes of the braided wire. Further, the state of the foil may be automatically detected using a device such as a sensor.

From the foregoing, it will be appreciated that various exemplary embodiments of the present disclosure have been described herein for purposes of illustration, and that various modifications may be made without departing from the scope and spirit of the present disclosure. Accordingly, the various exemplary embodiments disclosed herein are not intended to be limiting, with the true scope and spirit being indicated by the following claims.

What is claimed is:

1. A shielded cable end structure, comprising:
a core;
an insulator configured to cover the core;
a foil configured to cover the insulator;
a braided wire configured to cover the foil;
a sheath configured to cover the braided wire; and
a sleeve arranged between the braided wire and the foil exposed from an end part of the sheath,
wherein the end part of the sheath and the sleeve are separated from each other to form a clearance such that the braided wire directly covers the foil in the clearance.

2. The shielded cable end structure of claim 1, wherein the sleeve includes a tubular sleeve body having an inner diameter larger than an outer diameter of the foil.

3. The shielded cable end structure of claim 2, wherein the sleeve includes a plurality of protrusions arranged at intervals in a circumferential direction of the sleeve body and the plurality of protrusions are formed to project radially and inwardly and contact the foil.

4. The shielded cable end structure of claim 3, wherein the sleeve body includes:
a pair of small-diameter tube portions; and
a large-diameter tube portion arranged side by side with the pair of small-diameter tube portions and having a larger diameter than each of the pair of small-diameter tube portions, and
wherein an outer surface of the large-diameter tube portion serves as a receiving surface pressable by a barrel of a terminal.

5. The shielded cable end structure of claim 4, wherein:
the large-diameter tube portion is arranged in a central part in an axial direction of the sleeve body,
the pair of small-diameter tube portions are arranged on both end parts in the axial direction of the sleeve body, and
the plurality of protrusions are divided to be arranged in a same number on each of the pair of small-diameter tube portions on the both end parts in the axial direction of the sleeve body.

6. The shielded cable end structure of claim 1, wherein the sleeve includes a recess recessed in a direction away from the end part of the sheath on an edge part facing the end part of the sheath.

7. The shielded cable end structure of claim 6, wherein the sleeve includes a pair of auxiliary recesses provided on a facing edge part facing the edge part in a vertical direction, and each recessed in the direction away from the end part of the sheath.

8. The shielded cable end structure of claim 1, wherein the clearance is formed between the end part of the sheath from which the foil is exposed, and an end part of the sleeve positioned at a side opposite to a remaining end part of the sleeve from which the foil is exposed.

9. A sleeve provided in a shielded cable end structure, the shielded cable end structure comprising:

a core;

an insulator configured to cover the core;

a foil configured to cover the insulator;

a braided wire configured to cover the foil;

a sheath configured to cover the braided wire; and a sleeve arranged between the braided wire and the foil exposed from an end part of the sheath, and the sleeve comprising:

a tubular sleeve body having an inner diameter larger than an outer diameter of the foil;

a plurality of protrusions arranged at intervals in a circumferential direction of the sleeve body and the plurality of protrusions are formed to project radially and inwardly and contact the foil; and a recess recessed in a direction away from the end part of the sheath on an edge part facing the end part of the sheath, wherein the end part of the sheath and the sleeve are separated from each other to form a clearance such that the braided wire covers the foil in the clearance.

10. The sleeve provided in the shielded cable end structure of claim 9, wherein the sleeve body includes:

a pair of small-diameter tube portions; and a large-diameter tube portion arranged side by side with the pair of small-diameter tube portions and having a larger diameter than each of the pair of small-diameter tube portions, and wherein an outer surface of the large-diameter tube portion serves as a receiving surface pressable by a barrel of a terminal.

11. The sleeve provided in the shielded cable end structure of claim 10, wherein:

the large-diameter tube portion is arranged in a central part in an axial direction of the sleeve body, the pair of small-diameter tube portions are arranged on both end parts in the axial direction of the sleeve body, and the plurality of protrusions are divided to be arranged in a same number on each of the pair of small-diameter tube portions on the both end parts in the axial direction of the sleeve body.

12. The sleeve provided in the shielded cable end structure of claim 9, wherein the sleeve includes a recess recessed in a direction away from the end part of the sheath on an edge part facing the end part of the sheath.

* * * * *